US007537285B2

(12) United States Patent
Stewart

(10) Patent No.: US 7,537,285 B2
(45) Date of Patent: May 26, 2009

(54) DEVICE THAT AUTOMATICALLY ROCKS A ROCKING A CHAIR AND SIMILAR ARTICLES

(76) Inventor: Laverne L. Stewart, P.O. Box 96, Harveyville, KS (US) 66431

( * ) Notice: Subject to any disclaimer, the term of this patent is extended or adjusted under 35 U.S.C. 154(b) by 0 days.

(21) Appl. No.: 11/222,426

(22) Filed: Sep. 8, 2005

(65) Prior Publication Data

US 2007/0063558 A1 Mar. 22, 2007

(51) Int. Cl.
*A47C 3/02* (2006.01)

(52) U.S. Cl. ..... 297/260.1; 297/260.2; 297/271.6; 297/130

(58) Field of Classification Search ..... 297/260.1, 297/260.2, 260.3, 271.6, 271.2, DIG. 7, 130; 5/107, 108, 109
See application file for complete search history.

(56) References Cited

U.S. PATENT DOCUMENTS 1,241,171 A 9/1917 Vitullo
1,985,131 A 12/1934 Wilke
3,019,052 A * 1/1962 Zawadzki ..... 297/260.2
3,261,033 A * 7/1966 Martin ..... 5/109
3,548,810 A 12/1970 Hoyer
3,653,080 A * 4/1972 Hafele ..... 5/108
3,758,156 A 9/1973 Zawadski
3,886,608 A * 6/1975 Casella ..... 5/108
4,775,184 A 10/1988 Larkin
4,985,949 A * 1/1991 Jantz ..... 5/109
5,368,361 A * 11/1994 Wen-Ming ..... 297/260.2
5,615,428 A * 4/1997 Li ..... 5/109
5,806,113 A * 9/1998 McMahan et al. ..... 5/109
5,860,698 A * 1/1999 Asenstorfer et al. ..... 297/260.2
6,152,529 A 11/2000 Beason
6,412,867 B2 * 7/2002 Robinson ..... 297/260.2

* cited by examiner

*Primary Examiner*—Laurie K Cranmer
(74) *Attorney, Agent, or Firm*—Richard L. Miller

(57) ABSTRACT

A device that automatically rocks a rocking chair and similar articles. The rocking chair has a pair of rocker bars to provide rocking motion on a floor surface and a pair of arm rests. The device comprises a housing, a mechanism for attaching the housing onto a forward end of one of the rocker bars in a removable manner, and a mechanism within the housing, for raising and lowering the forward end of the rocker bar with respect to the floor surface, to automatically rock the rocking chair.

12 Claims, 2 Drawing Sheets

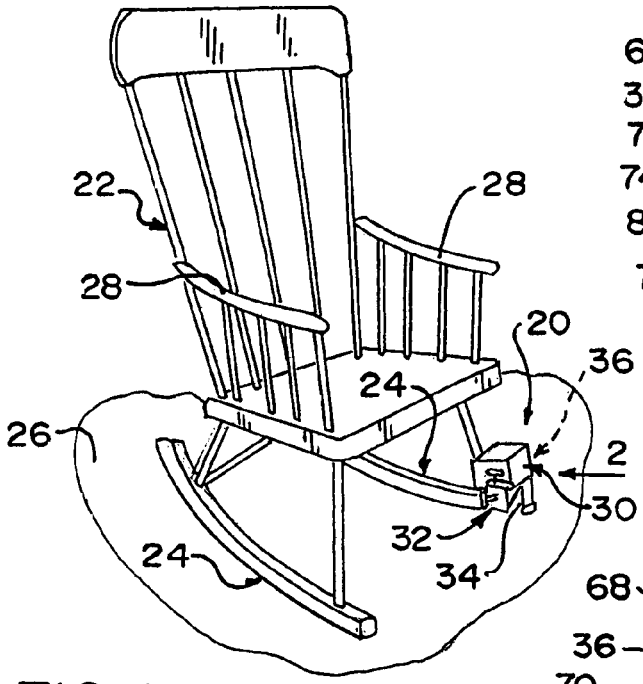
FIG. 1
FIG. 6
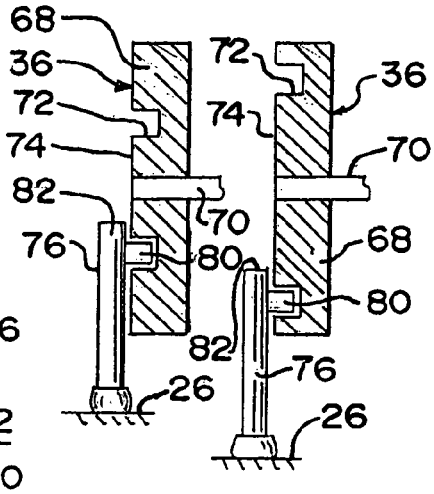
FIG. 5
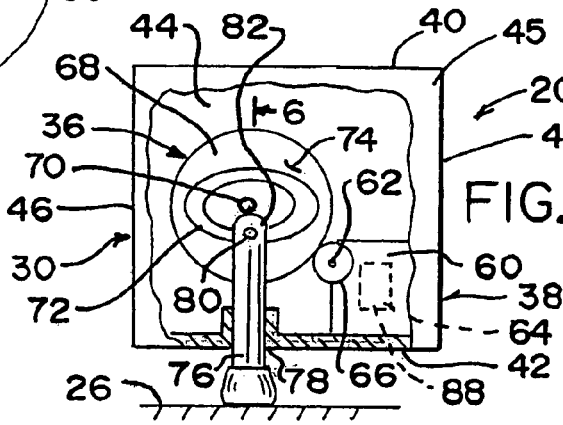
FIG. 4
FIG. 2
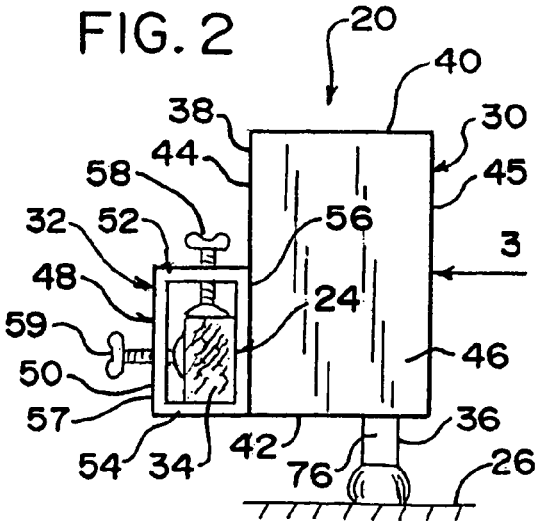
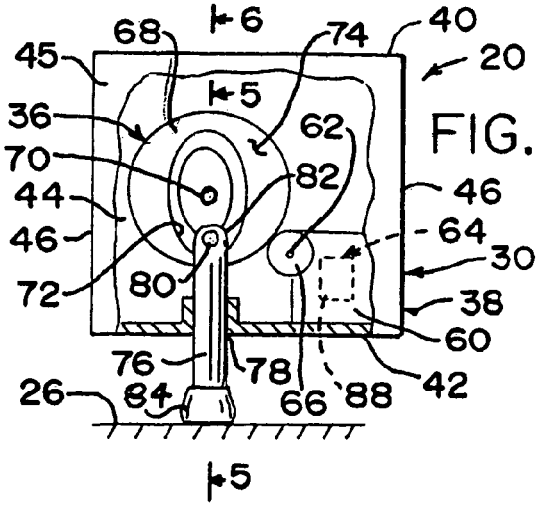
FIG. 3

DEVICE THAT AUTOMATICALLY ROCKS A ROCKING A CHAIR AND SIMILAR ARTICLES

BACKGROUND OF THE INVENTION

1. Field of the Invention

The present invention relates to a power rocking chair, and more particularly, the present invention relates to a device that automatically rocks a rocking chair and similar articles.

2. Description of the Prior Art

Numerous innovations for rocking chairs have been provided in the prior art that will be described. Even though these innovations may be suitable for the specific individual purposes to which they address, accordingly they differ from the present invention.

A FIRST EXAMPLE, U.S. Patent Office Document No. 1,241,171, Issued on Sep. 25, 1917, to Vitullo teaches a rocking chair comprising an elongated box like structure, a seat rockingly mounted on the rear portion of the structure, a leg rest extension having a hinge connection at its rear end with the seat and its front end free to move up and down, a supporting link pivotally secured to each side of the structure at its lower end approximately midway between the seat and the front end of the structure and pivotally secured at its upper end to the extension beyond the vertical plane of its connection to the structure and in a vertical plane nearer the front end of the structure, Bo that the links are inclined toward the front end of the structure when the seat is in normal position, whereby when the seat is rocked the supporting links swing upward and rearward.

A SECOND EXAMPLE, U.S. Patent Office Document No. 1,985,131, Issued on Dec. 18, 1934, to Wilke teaches a rocking chair, comprising a base member, a chair member mounted to rock on the base member, a motor mounted on one of the members, a crank arm carried by the motor, a lever pivoted on the member adjacent to the motor and having one end connected to the crank arm, and a spring connected to the other member and to the crank arm end of the lever, whereby when the motor is actuated the spring imparts a rocking motion to the chair.

A THIRD EXAMPLE, U.S. Patent Office Document No. 3,019,052, Issued on Jan. 30, 1962, to Zawadski teaches in a rocking chair assembly of the type comprising an arcuate base and a rocking chair member movably mounted thereon and provided with a vertical rotary driving member rotating in a vertical plane substantially transverse to the base, a mechanism defining a driving connection between an exposed portion of the rocking chair member and the vertical rotary driving member, comprising a crank arm pivoted to and extending upwardly from the rotary driving member, the crank arm being formed at its top end with a notch defining a pair of spaced upwardly extending parallel arms, a block member disposed between the arms with the major portion thereof housed in the notch, a transverse pin extending through the upper portion of the block member and the upper portions of the arms, pivotally connecting the upper portion of the block member to the arms so that the block member is swingable in the notch around a transverse horizontal axis, a post member rotatably connected to the block member at a point spaced below the last-named transverse horizontal axis and being Journaled to the block member on a axis contained in a vertical plane extending perpendicular to the plane of the block member, and a mechanism connecting the post member to the exposed portion of the rocking chair member.

A FOURTH EXAMPLE, U.S. Patent Office Document No. 3,548,810, Issued on Dec. 22, 1970, to Hoyer teaches a therapeutic chair contoured to support a patient in a reclining position and tiltable forwardly and rearwardly about a first horizontal axis on a spring base, the chair being comprised of a torso-supporting segment and a leg-supporting segment pivotally connected together at a second horizontal axis located between the patient's knee and hip Joints. A motor driven actuating mechanism serves to pivot the aforesaid leg-supporting segment upwardly and downwardly about the second horizontal axis to thereby alternately shift the patient's weight rearwardly and forwardly with the result that the chair rocks back and forth on the first horizontal axis. The patient's blood circulation is stimulated by the rocking movement of the chair and the raising and lowering of his legs by the pivotal movement of the leg-supporting segment with respect to the torso-supporting segment.

A FIFTH EXAMPLE, U.S. Patent Office Document No. 3,758,156, Issued on Sep. 11, 1973, to Zawadski teaches a rocking chair assembly including a flexible line connected at one end to a drive unit on the chair base and movably connected at the other end in a housing mounted on the movable rocking chair member. A manually operated control mechanism has a first position tightening the line thereby providing a driving connection between the drive units and the rocking chair member. The mechanism has a second position loosening the line thereby permitting free movement of the rocking chair member. The chair assembly can include a manually operated tension adjusting mechanism operatively connected to the line to compensate for the different weights and sizes of persons using the chair.

A SIXTH EXAMPLE, U.S. Patent Office Document No. 3,886,608, Issued on Jun. 3, 1975, to Casella teaches a rocker that includes rocker bars which are operatively connected to a base to permit controlled rocking movement of the rocker on the base, and an automatic rocking mechanism is operatively associated with at least one of the rocker bars for rocking the same. The automatic rocking mechanism comprises an electric motor and a crank rotatably driven by the motor, such crank being engageable with the adjacently disposed rocker bar for lifting the same for a relatively limited period in the rotational cycle of the crank, and the rocker bar being free to rock by itself when out of contact with the crank.

A SEVENTH EXAMPLE, U.S. Patent Office Document No. 4,775,184, Issued on Oct. 4, 1988, to Larkin teaches a rocking chair having a seat and a base member, the seat including a seat member for directly supporting a person a frame having first and second frame members, each of which frame members have a rocker portion disposed beneath the seat member and a vertical portion interconnecting the rocker portion and the seat member, the rocker portion of each frame member being curved for a substantial portion of its length and supported for rocking movement within the base member, a rear most portion of each rocker portion being angled upwardly, the frame members being constructed of a resilient material so that rocking motion of the seat causes a dampened spring motion of the seat during rocking of the chair. The chair further includes a motor to propel the chair in a rocking motion, the motor being attached to the base member so that the motor remains in a stationary position when the seat is in a rocking motion, and a mechanism connected to the motor for engaging the seat during at least a portion of its rocking motion so as to permit the seat to float free during a portion of its rocking motion.

AN EIGHTH EXAMPLE, U.S. Patent Office Document No. 6,152,529, Issued on Nov. 28, 2000, to Beason teaches a motor driven rocking chair that includes a seat assembly, a base assembly and a drive assembly. The seat assembly is rockably mounted onto the base assembly. The drive assembly is connected between the seat assembly and the base assembly and provides a rocking force to rock the seat assembly forward and rearward with respect to the base assembly.

It is apparent that numerous innovations for rocking chairs have been provided in the prior art that are adapted to be used. Furthermore, even though these innovations may be suitable for the specific individual purposes to which they address, however, they would not be suitable for the purposes of the present invention as heretofore described.

SUMMARY OF THE INVENTION

AN OBJECT of the present invention is to provide a device that automatically rocks a rocking chair and similar articles that avoids the disadvantage of the prior art.

ANOTHER OBJECT of the present invention is to provide a device that automatically rocks a rocking chair and similar articles that is simple and inexpensive to manufacture.

STILL ANOTHER OBJECT of the present invention is to provide a device that automatically rocks a rocking chair and similar articles that is simple to use.

BRIEFLY STATED, STILL YET ANOTHER OBJECT of the present invention is to provide a device that automatically rocks a rocking chair and similar articles. The rocking chair has a pair of rocker bars to provide rocking motion on a floor surface and a pair of arm rests. The device comprises a housing, a mechanism for attaching the housing onto a forward end of one of the rocker bars in a removable manner, and a mechanism within the housing, for raising and lowering the forward end of the rocker bar with respect to the floor surface, to automatically rock the rocking chair.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows:

FIG. 1 is a diagrammatic perspective view of the present invention being a device that automatically rocks a rocking chair and similar articles, in which the device is installed on a rocker bar of the rocking chair;

FIG. 2 is an enlarged diagrammatic front elevational view taken in the direction of arrow 2 in FIG. 1 showing the device per se in greater detail;

FIG. 3 is a diagrammatic side elevational view with parts broken away and in section, taken in the direction of arrow 3 in FIG. 2, showing a battery operated motor within the device, with a leg fully extended;

FIG. 4 is a diagrammatic side elevational view similar to FIG. 3, with the leg fully retracted;

FIG. 5 is an enlarged diagrammatic cross sectional view, with parts broken away, taken on line 5-5 in FIG. 3;

FIG. 6 is an enlarged diagrammatic cross sectional view, with parts broken away, taken on line 6-6 in FIG. 4;

A MARSHALLING OF REFERENCE NUMERALS UTILIZED IN THE DRAWING

Figure 7:
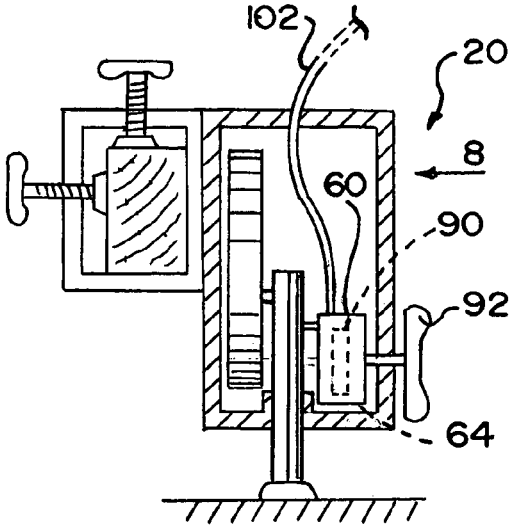
FIG. 7 is an enlarged diagrammatic front elevational view similar to FIG. 2, with parts broken away and in section of the present invention, showing a wind-up spring motor within the device.

| | |
|---|---|
| 20 | device |
| 22 | rocking chair |
| 24 | rocker bar of rocking chair 22 |
| 26 | floor surface |
| 28 | arm rest of rocking chair 22 |
| 30 | housing of device 20 |
| 32 | attaching mechanism of device 20 |
| 34 | forward end of rocker bar 24 |
| 36 | raising and lowering mechanism of device 20 |
| 38 | box shaped structure of housing 30 |
| 40 | top wall of box shaped structure 38 |
| 42 | bottom wall of box shaped structure 38 |
| 44 | first side wall of box shaped structure 38 |
| 45 | second side wall of box shaped structure 38 |
| 46 | end wall of box shaped structure 38 |
| 48 | clamp member of attaching mechanism 32 |
| 50 | sleeve shaped structure of clamp member 48 |
| 52 | top wall of sleeve shaped structure 50 |
| 54 | bottom wall of sleeve shaped structure 50 |
| 56 | first side wall of sleeve shaped structure 50 |
| 57 | second side wall of sleeve shaped structure 50 |
| 58 | first clamp screw of sleeve shaped structure 50 |
| 59 | second clamp screw of sleeve shaped structure 50 |
| 60 | motor of raising and lowering mechanism 36 |
| 62 | drive shaft of motor 60 |
| 64 | operating mechanism for motor 60 |
| 66 | small drive gear of raising and lowering mechanism 36 |
| 68 | large driven gear of raising and lowering mechanism 36 |
| 70 | driven shaft of large driven gear 68 |
| 72 | elliptical cam track of raising and lowering mechanism 36 |
| 74 | side surface of large driven gear 68 |
| 76 | leg of raising and lowering mechanism 36 |
| 78 | aperture in bottom wall 42 of box shaped structure 38 |
| 80 | cam follower of raising and lowering mechanism 36 |
| 82 | upper end of leg 76 |
| 84 | foot for leg 76 |
| 86 | lower end of leg 76 |
| 88 | battery of operating mechanism 64 |
| 90 | wind-up spring of operating mechanism 64 |
| 92 | key for wind-up spring 90 |
| 94 | first electrical wire of operating mechanism 64 |
| 96 | plug of operating mechanism 64 |
| 98 | free end of first electrical wire 94 |
| 100 | electrical wall outlet |
| 102 | control cable of operating mechanism 64 |
| 104 | remote control unit of operating mechanism 64 |
| 106 | free end of control cable 102 |

DETAILED DESCRIPTION OF THE PREFERRED EMBODIMENT

Referring now to the figures, in which like numerals indicate like parts, and particularly to FIG. 1, which is a diagrammatic perspective view of the present invention being a device that automatically rocks a rocking chair and similar articles, in which the device is installed on a rocker bar of the rocking chair.

The present invention being the device is shown generally at 20. The rocking chair 22 has a pair of rocker bars 24 to provide rocking motion on a floor surface 26 and a pair of arm rests 28. The device 20 comprises a housing 30. A mechanism 32 is for attaching the housing 30 onto a forward end 34 of one rocker bar 24 in a removable manner. A mechanism 36 within the housing 30 is for raising and lowering the forward end 34 of the rocker bar 24 with respect to the floor surface 26, to automatically rock the rocking chair 22.

The specific configuration of the device 20 can best be seen in the FIGS. 2, 3, 4, 5 and 6, which are an enlarged diagrammatic front elevational view taken in the direction of arrow 2 in FIG. 1 showing the device per se in greater detail; a diagrammatic side elevational view with parts broken away and in section, taken in the direction of arrow 3 in FIG. 2, showing a battery operated motor within the device with a leg fully extended; a diagrammatic side elevational view similar to FIG. 3, with the leg fully retracted; an enlarged diagrammatic cross sectional view, with parts broken away, taken on line 5-5 in FIG. 3; and an enlarged diagrammatic cross sectional view, with parts broken away, taken on line 6-6 in FIG. 4, and as such, will be discussed with reference thereto.

The housing 30 is a box shaped structure 38, wherein the box shaped structure 38 of the housing 30 comprises a top wall 40, a bottom wall 42, a pair of side walls 44, 45 and a pair of end walls 46. The attaching mechanism 32 comprises a clamp member 48, wherein the clamp member 48 is a sleeve shaped structure 50. The sleeve shaped structure 50 of the clamp member 48 comprises a top wall 52, a bottom wall 54 and a pair of side walls 56, 57 in which the first side wall 56 of the sleeve shaped structure 50 of the clamp member 48 is affixed to the first side wall 44 of the box shaped structure 38 of the housing 30. The sleeve shaped structure 50 of the clamp member 48 further comprises a pair of clamp screws 58, 59. The first clamp screw 58 is threaded into the top wall 52 of the sleeve shaped structure 50 of the clamp member 48. The second clamp screw 59 is threaded into the second side wall 57 of the sleeve shaped structure 50 of the clamp member 48. The pair of clamp screws 58, 59 hold the forward end 34 of the rocker bar 24 in a secure manner within the sleeve shaped structure 50 of the clamp member 48.

The raising and lowering mechanism 36 comprises a motor 60 mounted within the box shaped structure 38 of the housing 30, wherein the motor 60 has a drive shaft 62. A mechanism 64 is provided for operating the motor 60. A small drive gear 66 is rotatably connected to the drive shaft 62 of the motor 60. The small drive gear 66 is vertically positioned within the box shaped structure 38 of the housing 30. A large driven gear 68 having a driven shaft 70 is rotatably connected to the first side wall 44 of the box shaped structure 38 of the housing 30. The large driven gear 68 is vertically positioned within the box shaped structure 38 of the housing 30 and is in engagement with the small drive gear 66.

An elliptical cam track 72 is in a side surface 74 of the large driven gear 68. A leg is vertically positioned within the box shaped structure 38 of the housing 30. The leg 76 extends downwardly through an aperture 78 in the bottom wall 42 of the box shaped structure 38 of the housing 30 and makes contact with the floor surface 26. A cam follower 80 is affixed at a right angle to an upper end 82 of the leg 76. The cam follower 80 rides within the elliptical cam track 72 in the side surface 74 of the large driven gear 68. When the large driven gear 68 rotates on the driven shaft 70 by the small drive gear 66, the cam follower 80 in the elliptical cam track 72 moves the leg 76 in a receptacle manner up and down through the aperture 78 in the bottom wall 42 of the box shaped structure 38 of the housing 30. A foot 84 is affixed to a lower end 86 of the leg 76, whereby the foot 84 makes a firm contact with the floor surface 26. As shown in FIGS. 3 and 4, the operating mechanism 64 is a battery 88 electrically connected to the motor 60.

Figure 8:
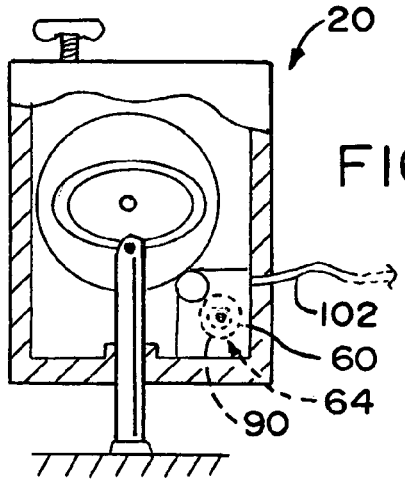
FIG. 8 is a diagrammatic side elevational view, with parts broken away and in section, taken in the direction of arrow 8 in FIG. 7.

Another type of operating mechanism 64 is shown in FIGS. 7 and 8, which are an enlarged diagrammatic front elevational view similar to FIG. 2, with parts broken away and in section of the present invention, showing a wind-up spring motor within the device; and a diagrammatic side elevational view, with parts broken away and in section, taken in the direction of arrow 8 in FIG. 7 and as such, will be discussed with reference thereto. The operating mechanism 64 is a wind-up spring 90 mechanically connected to the motor 60. The wind-up spring 90 comprises a key 92 which is manually turned by a person.

Figure 10:
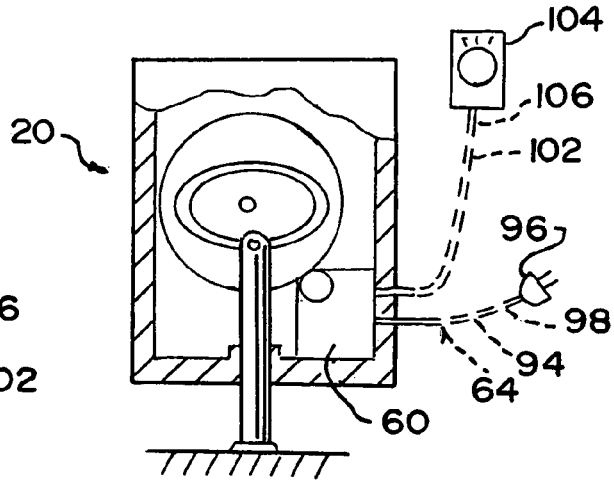
FIG. 10 is an enlarged diagrammatic side elevational view, with parts broken away and in section, taken in the direction of arrow 10 in FIG. 9, showing the device per se in greater detail with an electric motor therein.
Figure 9:
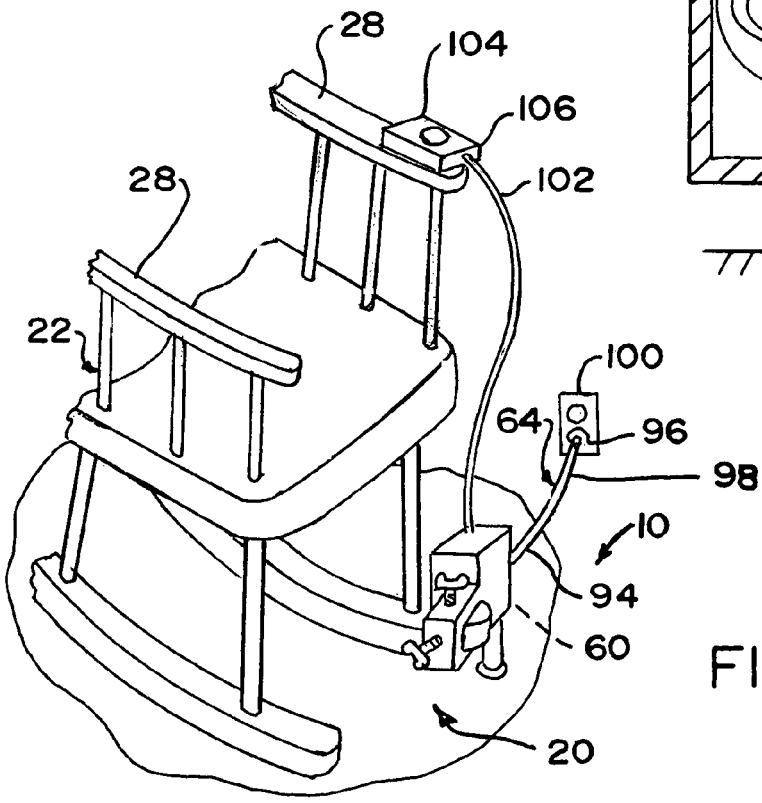
FIG. 9 is a diagrammatic perspective view of the present invention installed on a rocker bar of the rocking chair with a remote control unit mounted on an arm rest of the rocking chair, with the rocking chair broken away.

Still another type of operating mechanism 64 is shown in FIGS. 9 and 10, which are a diagrammatic perspective view of the present invention installed on a rocker bar of the rocking chair with a remote control unit mounted on the arm rest of the rocking chair, with the rocking chair broken away; and an enlarged diagrammatic side elevational view, with parts broken away and in section, taken in the direction of arrow 10 in FIG. 9, showing the device per se in greater detail with an electric motor therein and as such will be discussed with reference thereto.

The operating mechanism 64 is a first electrical wire 94 connected to the motor 60. The first electrical wire 94 includes a plug 96 on a free end 98, which plugs into an electrical wall outlet 100 to supply electricity to the motor 60. The operating mechanism 64 further comprises a control cable 102 connected to the motor 60. The control cable 102 includes a remote control unit 104 on a free end 106 thereof, which is mounted on the arm rest 28 of the rocking chair 22 to control speed of the motor 60 and deactivate it completely when desired.

It will be understood that each of the elements described above, or two or more together, may also find a useful application in other types of constructions differing from the types described above.

While the invention has been illustrated and described as embodiments of a device that automatically rocks a rocking chair and similar articles, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A device that automatically rocks a rocking chair and similar articles, the rocking chair having a pair of rocker bars to provide rocking motion on a floor surface and a pair of arm rests, said device comprising:

A) a housing;

B) means for attaching said housing onto a forward end of one of the rocker bars in a removable manner; and C) means within said housing, for raising and lowering the forward end of the rocker bar with respect to the floor surface, to automatically rock the rocking chair, wherein said housing is a box shaped structure, wherein said box shaped structure of said housing comprises a top wall, a bottom wall, a pair of side walls and a pair of end walls, wherein said raising and lowering means comprises:

a) a motor mounted within said box shaped structure of said housing, said motor having a drive shaft;

b) means for operating said motor;

c) a small drive gear rotatably connected to said drive shaft of said motor, wherein said small drive gear is vertically positioned within said box shaped structure of said housing;

d) a large driven gear having a driven shaft rotatably connected to said second side wall of said box shaped structure of said housing, wherein said large gear is vertically positioned within said box shaped structure of said housing and in engagement with said small drive gear;

e) an elliptical cam track in a side surface of said large driven gear;

f) a leg vertically positioned within said box shaped structure of said housing, wherein said leg extends downwardly through an aperture in said bottom wall of said box shaped structure of said housing to contact the floor surface; and g) a cam follower affixed at a right angle to an upper end of said leg, wherein said cam follower rides within said elliptical cam track in said side surface of said large driven gear, whereby when said large driven gear rotates on said driven shaft by said small drive gear, said cam follower in said elliptical cam track moves said leg in a reciprocal manner up and down through said aperture in said bottom wall of said box shaped structure of said housing.

2. The device as recited in claim 1, wherein said attaching means comprises a clamp member.

3. The device as recited in claim 2, wherein said clamp member is a sleeve shaped structure.

4. The device as recited in claim 3, wherein said sleeve shaped structure of said clamp member comprises a top wall, a bottom wall and a pair of side walls, in which said first side wall of said sleeve shaped structure of said clamp member is affixed to said first side wall of said box shaped structure of said housing.

5. The device as recited in claim 4, wherein said sleeve shaped structure of said clamp member comprises a pair of clamp screws, in which said first clamp screw is threaded into said top wall of said sleeve shaped structure of said clamp member, while said second clamp screw is threaded into said second side wall of said sleeve shaped structure of said clamp member, whereby said pair of clamp screws hold the forward end of the rocker bar in a secure manner within said sleeve shaped structure of said clamp member.

6. The device as recited in claim 1, further comprising a foot affixed to a lower end of said leg, whereby said foot makes a firm contact with the floor surface.

7. The device as recited in claim 1, wherein said operating means is a battery electrically connected to said motor.

8. The device as recited in claim 1, wherein said operating means is a wind-up spring mechanically connected to said motor.

9. The device as recited in claim 8, wherein said wind-up spring comprises a key which is manually turned by a person.

10. The device as recited in claim 1, wherein said operating means is a first electrical wire connected to said motor, wherein said first electrical wire includes a plug on a free end which plugs into an electrical wall outlet to supply electricity to said motor.

11. The device as recited in claim 10, wherein said operating means further comprises a control cable connected to said motor, wherein said control cable includes a remote control unit mounting on the arm rest of the rocking chair to control speed of said motor.

12. The device as recited in claim 1, wherein said operating means further comprises a control cable connected to said motor, wherein said control cable includes a remote control unit for mounting on the arm rest of the rocking chair to control speed of said motor.

* * * * *